US007914884B2

(12) United States Patent
Royer et al.

(10) Patent No.: US 7,914,884 B2
(45) Date of Patent: Mar. 29, 2011

(54) FABRIC REINFORCED CEMENT

(75) Inventors: Joseph R. Royer, Greenville, SC (US); Randolph S. Kohlman, Boiling Springs, SC (US); Samuel E. Graham, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 1565 days.

(21) Appl. No.: 11/065,405

(22) Filed: Feb. 24, 2005

(65) Prior Publication Data

US 2005/0233656 A1 Oct. 20, 2005

Related U.S. Application Data

(63) Continuation-in-part of application No. 10/786,272, filed on Feb. 25, 2004, now Pat. No. 6,960,394.

(51) Int. Cl.
*B32B 13/02* (2006.01)
*B32B 27/00* (2006.01)
*B32B 13/06* (2006.01)

(52) U.S. Cl. ..... 428/294.7; 428/292.1; 428/394; 428/364; 428/113; 442/1; 442/2; 442/17

(58) Field of Classification Search ..... 442/2, 292.1, 442/1, 17; 428/292.1, 113, 105, 394, 364, 428/294.7
See application file for complete search history.

(56) References Cited

U.S. PATENT DOCUMENTS 3,446,251 A * 5/1969 Dow ..... 139/383 R
3,903,879 A * 9/1975 Riley et al. ..... 602/8
4,306,911 A 12/1981 Gordon et al. ..... 106/99
4,413,110 A * 11/1983 Kavesh et al. ..... 526/348.1
4,455,273 A * 6/1984 Harpell et al. ..... 264/184
4,578,301 A 3/1986 Currie et al. ..... 428/109
4,581,275 A * 4/1986 Endo et al. ..... 428/113
4,778,718 A 10/1988 Nicholls ..... 428/287
4,894,270 A 1/1990 Nicholls ..... 428/125
4,899,498 A 2/1990 Grieb ..... 52/144
5,114,653 A 5/1992 Schuerhoff et al. ..... 264/228
5,350,554 A 9/1994 Miller ..... 264/171
5,549,863 A 8/1996 Symons ..... 264/257
5,705,233 A 1/1998 Denes et al. ..... 427/538
5,766,724 A 6/1998 Tailor et al. ..... 428/110
5,891,374 A 4/1999 Shah et al. ..... 264/108
5,902,528 A 5/1999 Spragg ..... 264/42
6,069,192 A 5/2000 Shalaby et al. ..... 532/205
6,110,588 A 8/2000 Perez et al. ..... 428/359
6,156,842 A 12/2000 Hoenig et al. ..... 525/171
6,263,574 B1 7/2001 Lubker et al. ..... 29/897.32
6,358,575 B1 3/2002 Spragg ..... 428/34.1
6,418,610 B2 7/2002 Lubker et al. ..... 29/525.01
6,420,024 B1 7/2002 Perez et al. ..... 428/359
6,432,347 B1 8/2002 Perez et al. ..... 264/444
6,468,451 B1 10/2002 Perez et al. ..... 264/48
6,528,151 B1 3/2003 Shah et al. ..... 428/221
6,586,073 B2 7/2003 Perez et al. ..... 428/141
6,586,606 B2 7/2003 Gerster et al. ..... 549/302
(Continued)

*Primary Examiner* — Angela Ortiz
*Assistant Examiner* — Altrev C Sykes
(74) *Attorney, Agent, or Firm* — Cheryl J. Brickey

(57) ABSTRACT

The present disclosure relates to cementitious articles that are reinforced with a fabric made at least partially of high modulus polyolefin monofilament fibers. Preferably, the polypropylene monofilament yarns have a 3% secant modulus of elasticity of at least 100 g/denier. The high modulus polypropylene fabric has an intrinsic resistance to the alkaline conditions present in a cementitious composite, as well as a low elongation at break. The high modulus polypropylene may contain a nucleating agent to facilitate the process of obtaining desired draw ratio.

34 Claims, 3 Drawing Sheets

U.S. PATENT DOCUMENTS

| | | | | |
|---|---|---|---|---|
| 6,759,124 | B2 * | 7/2004 | Royer et al. | 428/372 |
| 2001/0010116 | A1 | 8/2001 | Lubker et al. | 29/525.11 |
| 2002/0034610 | A1 | 3/2002 | Perez et al. | 428/141 |
| 2003/0044592 | A1 | 3/2003 | Perez et al. | 428/294.7 |
| 2003/0176593 | A1 | 9/2003 | Bordes et al. | 525/419 |
| 2004/0025465 | A1 * | 2/2004 | Aldea et al. | 52/514 |

* cited by examiner

FABRIC REINFORCED CEMENT

CROSS-REFERENCE TO RELATED APPLICATIONS

This application is a Continuation-In-Part of U.S. patent application Ser. No. 10/786,272, entitled "Fabric Reinforced Cement", filed Feb. 25, 2004 now U.S. Pat. No. 6,960,394, and hereby incorporated in its entirety by reference.

TECHNICAL FIELD

The present invention relates generally to reinforced cementitious articles, and, in particular, to cementitious articles, panels, composites, and boards that are reinforced with a fabric that comprises high modulus polypropylene yarns that are inherently resistant to highly alkaline conditions.

BACKGROUND

The use of reinforcing materials for cementitious articles, composites, boards and panels is well known in the cement and construction industries. Generally, cement tends to be strong under compression, but tends to crack and break under tensile, shearing, bending, curing, or shrinkage forces, and must therefore be reinforced. For example, roadways that use asphaltic-type cementitious materials degrade over time, resulting in potholes due to reflective cracking, rutting, and rolling up at traffic lights. Reinforcing materials of various types are used to make such roadways more durable.

Other cementitious articles, such as columns, flat slabs, cementitious boards or precast slabs, tiles, and constant cross-section articles such as pipes, deteriorate over time due to use stress, seismic activity, or rough handling during manufacture or installation of the article. These articles may require a reinforcing material to impart sufficient mechanical properties for their intended use. Specifically, cementitious panels or boards, which are typically used for tile underlayment, exterior insulation and finish systems (EIFS), or precast slabs, may contain a core formed of a cementitious material that is interposed between one or more layers of facing material. The facing materials employed typically possess the features of high strength, high modulus of elasticity, and light weight and contribute flexural, impact, and tensile strength to the cementitious composite board, so that it may be handled before and during installation without cracking.

The technology of choice for reinforcing cementitious articles depends upon the function of the article, but can involve the use of steel, carbon, fiberglass, synthetic thermoplastic staple fibers including olefins, polyesters, amides, polyvinyl alcohol (PVOH), and polyvinyl acetate (PVA). For these applications, the reinforcing materials are incorporated as continuous rods, meshes, fabrics, and/or chopped fibers. Some applications require only chopped fibers to improve toughness, durability, and impact strength, to reduce shrinkage, and to prevent cracking during curing. However, many applications require continuous filaments to provide improved tensile and bending characteristics to the cementitious composite. Because most cementitious articles tend to crack and break at very low tensile elongations, the reinforcing materials must possess a high tensile modulus or alternatively a high tensile strength at low elongation to effectively reinforce the cementitious articles.

The predominant reinforcement materials, chosen for both their performance and relative economics are steel and fiberglass. Unfortunately, these materials suffer from a serious drawback: they tend to corrode or degrade when put into the environment in which they are to act as a reinforcement. Reinforcing materials made from steel are susceptible to corrosion, which can result in a "spalling" effect that causes breakup and deterioration of the cementitious article. Fiberglass, on the other hand, is susceptible to strength loss in the alkaline environment that results when common cements, such as Portland cement, are mixed with water during their curing.

To prevent these problems, specialized coatings are required on these reinforcing materials to allow them to retain their strength during their lifetime. Steel rebar, for instance, is coated with epoxies to prevent corrosion of the steel bar. However, it is very difficult to get a uniform coating on steel in the first place, compounded by the ease of damage to the coating due to rough handling of the steel during the manufacture of the cementitious article. Any imperfection in the coating can result in a portion of the article having substandard performance or a failure (such as a crack or break).

Fiberglass is also coated to protect its strength when used in cementitious composites. For example, cementitious boards typically include a fiberglass fabric reinforcement structure that is coated with a protective poly(vinyl chloride) (PVC) coating. The PVC coating, typically applied as a plastisol, is required to protect the fiberglass yarn and fabric from degradation resulting from exposure to the alkali conditions encountered during the curing of the cementitious article. Any imperfections in the coating (as may occur with conventional coating methods, even when using PVC coatings) result in possible sites for alkali attacks, which may be accelerated if heat is applied to cure the cementitious articles. Since it is difficult to get a uniform protective coating, strength loss for the fiberglass is expected. In fact, the specifications for the glass reinforcement for cementitious boards indicate how much strength loss can be tolerated for a particular fiberglass reinforcement. Therefore, to compensate for potential degradation of the fiberglass that may occur at uncoated, or partially coated, sites, excess fiberglass is often included to ensure a minimum necessary amount of strength over the life of the cement articles.

Typical polypropylene fabrics, though they are intrinsically resistant to the alkaline conditions present in cementitious material and do not corrode, are not of sufficient tensile modulus to be used as a tensile reinforcement for cementitious articles, panels, composites and boards. They are generally only used in staple form to reduce cracking during curing in the conventional art.

Accordingly, there remains a need for improved cementitious articles, composites, panels, or boards that are reinforced by an economical, high modulus fabric that both minimizes or eliminates the need to include a protective coating and that retains the beneficial features of other facing materials. Thus, the present invention relates to cementitious articles that are reinforced through the use of fabrics made from unique high modulus polypropylene yarns, which are by their chemical nature resistant to an alkaline medium.

SUMMARY

The present disclosure is directed toward reinforced cementitious articles, composites, panels, or boards, wherein the reinforcement material is a high modulus polypropylene monofilament fabric with intrinsic alkaline resistance. Because polypropylene is intrinsically alkaline and corrosion resistant, there is little to no reduction in the tensile properties of the fabric after curing in a cementitious composite.

One example of a cementitious article or composite is a cement panel reinforced with high modulus monofilament fabric. The cement panel includes a core layer that is made of a cementitious composition. In one embodiment, the core layer is covered with a layer of high modulus reinforcing polypropylene monofilament fabric on one or two sides with each fabric layer being bonded to the core with a coating of cementitious material on the top and on the bottom of the core layer. On the border edge regions of the cement panels, the fabric layer from one side may be overlapped over the fabric layer on the opposite side to augment the strength of these regions.

Additional examples of reinforced cementitious articles include: EIFS (exterior insulation and finish systems), precast cementitious walls and structures, prestressed concrete, structural and decorative members, cementitious flooring, countertops, stamped or rolled decorative articles, chemical or water tanks, poured cementitious foundations, roofing tile and decking systems, and road underlays. While reinforcements such as steel rebar are typically used for a long term support of an underlying structure, high modulus polypropylene monofilament fabric may be used as a crack preventative reinforcement during initial curing and may be used to supplement other structural reinforcement members (such as fiberglass or steel).

A feature of the present article described herein is the use of high modulus polypropylene monofilament yarns to construct a reinforcement scrim or fabric for cementitious articles, composites, panels, or boards. The use of polypropylene, an inherently alkaline resistant material, minimizes or altogether eliminates the need for a protective coating on the reinforcing yarns. Additionally, using high modulus polypropylene monofilaments produces high tensile modulus and low elongation similar to other reinforcing materials, such as fiberglass or steel, but with a substantially lower total article weight.

High modulus monofilament polypropylene fabric breaks at higher elongations (approximately between 3% and 9%) than fiberglass (that breaks at elongations of approximately 1%-3%), provides comparable tensile strength to fiberglass, and produces more impact resistance to the cementitious composites than may be achieved with the use of fiberglass alone. In certain embodiments, such as cementitious panels or boards, the modulus of elasticity of high modulus monofilament polypropylene fabric is similar to that of the cement; therefore, the cement board or panel is less likely to fail as a result of being too brittle or too flexible.

Further, because polypropylene is more resistant to alkali attack than fiberglass, the reinforcement fabric will degrade little in alkaline conditions during the life of the article. As a result, compared with reinforcing materials such as coated fiberglass that degrade substantially in the alkaline conditions of cementitious boards, less high modulus polypropylene fiber needs to be employed in the reinforcement of the panels.

In addition, compared to other polypropylene reinforcing products available on the market, the lower shrinkage monofilament yarns disclosed herein maintain their high modulus characteristic better at elevated temperatures, such as those experienced during certain cement curing processes. Another advantage of the higher elongation of the current reinforcing fabric is that, even if the cementitious article cracks, the reinforcing fabric is capable of holding the article together, preventing it from fracturing into distinct pieces. Though the polypropylene reinforcement scrim or fabric breaks at elongations of between 3% and 9%, the reinforcement scrim used in a board application does not break because the tensile modulus is high enough to support the weight of the board. In contrast, at elongation around 3%, the fiberglass reinforcement breaks, causing the board to snap. Because the polypropylene reinforcement fabric does not break, the cement board can still be handled and potentially used in application, even if there are cracks in the cement board.

DETAILED DESCRIPTION

Figure 1:
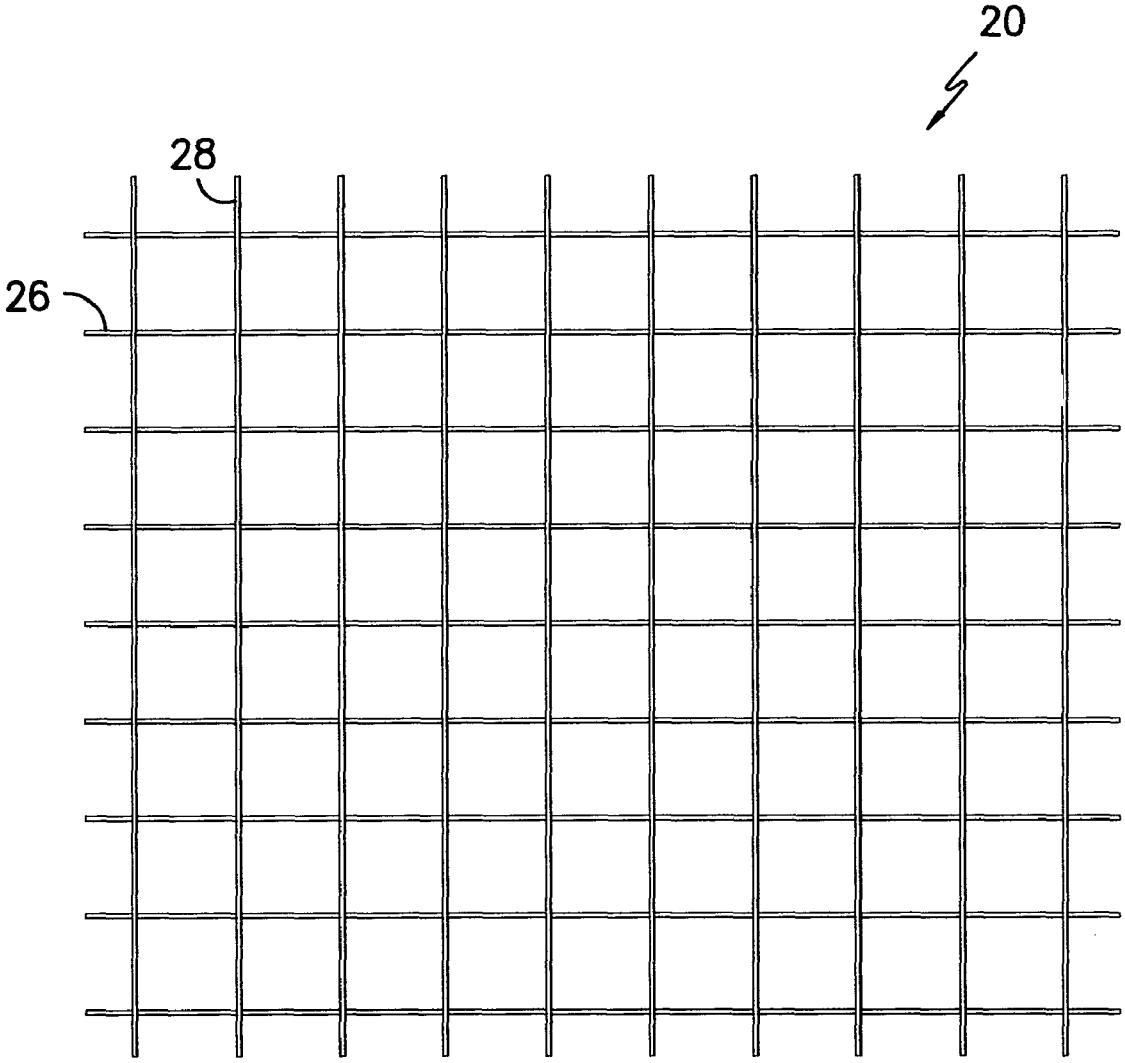
FIG. 1 is a top view of a bi-axial reinforcement fabric for use in combination with cement panels according to a first embodiment contemplated herein.

All patents and applications mentioned herein are hereby incorporated by reference in their entirety.

The present disclosure is directed to a fabric reinforcement for cementitious articles, composites, panels and boards that comprises high modulus polyolefin monofilament yarns. The high modulus monofilament yarns are polyolefin-based and are principally comprised of polypropylene. High modulus yarns are produced according to the teachings herein and may optionally include a nucleating agent.

The term "polypropylene" is intended to encompass any polymeric composition comprising propylene monomers, either alone or in mixture or copolymer with other randomly selected and oriented polyolefins, dienes, or other monomers (such as ethylene, butylene, and the like). Such a term also encompasses the different configurations and arrangements of the constituent monomers (such as syndiotactic, isotactic, and the like). Thus, as applied to fibers, the term is intended to encompass actual long strands, tapes, threads, and the like, of drawn polymer. The polypropylene may be of any standard melt flow (by testing); however, standard fiber grade polypropylene resins possess a range of Melt Flow Indices from about 2 and 50. A preferred range is from about 2 to about 35, a more preferred range is from about 2 to about 12, and a most preferred range is from about 2 to about 6. Blends of polypropylene with preferably less than 10%, more preferably less than 5% and most preferably less than 2% polyethylene may be advantageous.

The terms "nucleators", "nucleator compounds", and "nucleating agents" are intended to generally encompass, singularly or in combination, any additive to polypropylene that produces nucleation sites for polypropylene crystals during its from transition from the molten state to a solid, cooled structure.

The term "mechanical drawing" or "mechanically drawn", or the like, is intended to encompass any number of procedures that basically involve placing an extensional force on fibers in order to elongate the polymer therein. Such a procedure may be accomplished with any number of apparati, including, without limitation, godet rolls, nip rolls, steam cans, hot or cold gaseous jets (air or steam), and other like mechanical means.

Yarns

The preferred yarns are thermoplastic (polypropylene, specifically) monofilament yarns that are described in U.S. Pat. No. 6,759,124 to Morin et al. and U.S. patent application Ser. No. 10/443,003. Such fibers are manufactured through the extrusion of thermoplastic resins that may, in one preferred embodiment, include a certain class of nucleating agent therein. The fibers, optionally containing these nucleating agents, are able to be drawn at high ratios such that the tenacity and modulus are much higher than other previously produced extruded thermoplastic monofilament polypropylene fibers, particularly those produced under commercial conditions and those that also simultaneously exhibit extremely low shrinkage rates. This fiber (preferably produced from polypropylene) is mechanically drawn to a sufficiently high draw ratio to produce a 3% secant modulus of elasticity greater than 100 grams/denier, more preferably greater than 120 g/den, and most preferably greater than 150 g/den.

Generally speaking, the nucleating compounds described herein include any structure that nucleates polymer crystals within the target thermoplastic after applying sufficient heat to melt the pelletized polymer, drawing the polymer to orient the polymer chains, and then allowing such an oriented polymer to cool. The nucleator compounds give rise to polymer crystallization during cooling at a higher temperature than the same thermoplastic without the nucleating agent. In such a manner, the "rigidifying" nucleator compounds provide nucleation sites for thermoplastic crystal growth.

The preferred nucleator compounds include dibenzylidene-sorbitol types including, without limitation, dibenzylidene sorbitol (DBS); monomethyl dibenzylidene sorbitol, such as 1,3:2,4-bis(p-methylbenzylidene) sorbitol (p-MDBS); dimethyl dibenzylidene sorbitol, such as 1,3:2,4-bis(3,4-dimethylbenzylidene) sorbitol (3,4-DMDBS); as well as less preferred compounds, such as [2.2.1]heptane-bicyclodicarboxylic acid, sodium benzoate, talc, and certain sodium and lithium phosphate salts, such as sodium 2,2'-methylene-bis-(4,6-di-tert-butylphenyl)phosphate.

In another embodiment, the yarn comprises a monofilament thermoplastic fiber similar to that described above, but which does not contain a nucleating agent. This fiber (preferably produced from polypropylene) is drawn to a sufficiently high draw ratio to produce a 3% secant modulus of elasticity greater than 100 grams/denier, more preferably greater than 120 g/den, and most preferably greater than 150 g/den. When the monofilament is drawn to this high extent, it will often exhibit characteristics of over-drawing. For instance, the monofilament polypropylene fiber will become opaque due to small fibrillations or voids generated within the fiber. For this reason, such yarn need not contain pigment opacifiers, such as titanium dioxide, which are often added to produce an opaque fiber.

Typical polypropylene monofilament staple and continuous fibers used in construction and cementitious applications have 3% secant modulus values of between 20 grams/denier and 80 grams/denier. This polypropylene is typically added to cementitious articles to reduce cracking rather than to provide mechanical reinforcement.

Unlike the typical polypropylene fibers described above, one preferred embodiment of the present yarn includes a monofilament thermoplastic polypropylene fiber comprising at least one nucleating compound, wherein said fiber exhibits a shrinkage rate of at most 10% at 275° F. (135° C.) and a 3% secant modulus of at least 100 g/den, and optionally a tenacity measurement of at least 5 g/den.

In a second preferred embodiment is envisioned a polypropylene monofilament fiber without a nucleating agent that meets these specific physical characteristics. Such fibers can have any cross-section; two common cross sections include a round cross section and a highly elongated rectangular cross section.

A method of producing such high modulus polypropylene fibers comprises the sequential steps of (a) extruding a heated formulation of thermoplastic resin, optionally comprising at least one nucleator compound, into a fiber; (b) immediately quenching the fiber of step "a" to a temperature that produces a solid fiber with minimal orientation; (c) mechanically drawing said individual fibers at a draw ratio of at least 10:1 while exposing said fibers to a temperature of at between 250° F. and 450° F. (121° C. and 232° C.), preferably between 300° F. and 450° F. (149° C. and 232° C.), and most preferably between 340° F. and 450° F. (171° C. and 232° C.), thereby permitting crystal orientation of the polypropylene therein; and (d) optionally, heat setting the oriented fiber.

Preferably, step "b" will be performed at a temperature of at most about 203° F. (95° C.) and at least about 41° F. (5° C.), preferably between 41° F. (5° C.) and 140° F. (60° C.), and most preferably between 50° F. (10° C.) and 104° F. (40° C.) (or as close to room temperature as possible for a liquid by simply allowing the bath to acclimate itself to an environment at a temperature of about 25° C. to 30° C.). The quench is facilitated by using a liquid with a high heat capacity such as water.

Upon the heated draw step (step "c"), orientation is effectuated, which provides the necessary strength and modulus of the target fibers. Generally, high draw ratios result in breakage of the fibers during manufacture, leading to greater costs and much longer manufacturing times (if possible). However, high draw ratios are capable of producing fibers with greater tensile strength and modulus strength.

The addition of at least one nucleator compound to the thermoplastic resin before it is subjected to high draw ratio allows for the production of an ultra-high modulus monofilament fiber with significantly less shrinkage than a fiber generated under similar conditions without the nucleator compound. Nevertheless, materials generated without the nucleator compound are still advantageous for producing ultra-high modulus monofilament fibers that are necessary for the applications discussed here.

Thus, as a continuous process, this method provides surprisingly good results in physical characteristics by permitting high draw ratios to be utilized without breakage of the fibers during production. To effectuate such desirable physical characteristics, the drawing speed to line speed ratio should exceed at least 10:1; preferably at least 12:1; more preferably, at least 15:1; and most preferably, at least 18:1 (that is, 10-18 times that of the rate of movement of the fiber through the production line after extrusion). Preferably, such a drawing speed is from 400-2000 feet/minute, whereas the prior speed of the fibers is from about 20-400 feet/minute, creating a drawing speed ratio between the two areas of from about 10:1 to about 20:1. These processing conditions are discussed in greater detail below, as is the preferred method itself.

The optional final heat-setting (step "d") is performed at a temperature that "locks" the crystalline polypropylene structure in place after extruding and drawing. This heat-setting step generally lasts for between a portion of a second up to potentially two minutes. The heat-setting temperature should be in excess of the drawing temperature and is preferably at least 265° F. (129° C.), more preferably at least about 300° F. (149° C.), and most preferably at least about 350° F. (177° C.), and could be as high as 450° F. (232° C.).

All shrinkage values discussed correspond to fiber exposure times of about 5 minutes to the heat source. The heat-shrinkage for the fiber at about 275° F. (135° C.) in hot air is at most 10%; preferably, at most 7%; more preferably, at most 5%; and most preferably, at most 2%.

The amount of nucleating agent present within the monofilament fiber should be sufficient to provide the desired high draw ratios and shrinkage rates after heat-setting (as described above). Amounts of nucleating agent contemplated for use within the fiber are from about 0 to about 5,000 ppm.

Preferably, for economic reasons, the amounts of nucleating agent used should be kept as low as possible and, in fact, may not be necessary. However, under certain conditions, the amount of nucleating agent is preferably between at least 500 ppm and at most 5000 ppm (for tensile strength retention); and more preferably is between at least 1000 ppm and 4000 ppm; and most preferably is no higher than 3000 ppm.

The polypropylene composition (including nucleator compounds) must be molten to be extruded into a fiber. The nucleator compound provides nucleation sites upon cooling of the polypropylene from its molten state, but these sites must form prior to polypropylene recrystallization. Thus, any compound that exhibits such a beneficial effect and property is included within this definition of "nucleating agent." Such nucleator compounds more specifically include dibenzylidene-sorbitol types including, without limitation, dibenzylidene sorbitol (DBS); monomethyl dibenzylidene sorbitol, such as 1,3:2,4-bis(p-methylbenzylidene) sorbitol (p-MDBS); dimethyl dibenzylidene sorbitol, such as 1,3:2,4-bis(3,4-dimethylbenzylidene) sorbitol (3,4-DMDBS); as well as less preferred compounds, such as [2.2.1]heptane-bicyclodicarboxylic acid, sodium benzoate, talc, and certain sodium and lithium phosphate salts, such as sodium 2,2'-methylene-bis-(4,6-di-tert-butylphenyl)phosphate.

Generally speaking, the selection criteria required of such nucleator compounds are particle sizes (the lower the better for ease in handling, mixing, and incorporation with the target resin); particle dispersability within the target resin (to provide the most effective nucleation properties); and nucleating temperature (i.e., crystallization temperature, determined for resin samples through differential scanning calorimetry analysis of molten nucleated resins, where the higher such a temperature, the better).

It has been determined that the nucleator compounds that exhibit good solubility in the target molten polypropylene resins (and thus are liquid in nature during that stage in the fiber-production process) provide the most effective low-shrink characteristics. Thus, low substituted DBS compounds (including DBS, p-MDBS, DMDBS) appear to provide fewer manufacturing issues, while providing lower shrink properties within the finished polypropylene fibers themselves. Although p-MDBS and DMDBS are preferred, any of the above-mentioned nucleators may be utilized within these fibers, with varying ability to achieve the desired low shrink requirements. Mixtures of such nucleators may also be used during processing to provide such low-shrink properties as well as possible organoleptic improvements, facilitation of processing, or lowered cost.

In addition to those compounds noted above, sodium benzoate and sodium 2,2'-methylene-bis-(4,6-di-tert-butylphenyl)phosphate are well known as nucleating agents for standard polypropylene compositions (such as plaques, containers, films, sheets, and the like), because they exhibit excellent recrystallization temperatures and very quick injection molding cycle times for those purposes. The dibenzylidene sorbitol types exhibit the same types of properties as well as excellent clarity within such standard polypropylene forms (plaques, sheets, etc.). For the purposes of the reinforced cementitious articles contemplated herein, it has been found that the dibenzylidene sorbitol types are preferred as nucleator compounds within the target polypropylene fibers.

Reinforcement Fabric or Scrim

As used herein, the term "scrim" shall mean a fabric having an open construction used as a base fabric or a reinforcing fabric, which may be manufactured as an adhesively or thermally bonded laid scrim, a woven scrim, a weft-inserted warp knit scrim, a multi-axial warp knit scrim, a stitch-bonded scrim, or a cross-plied scrim.

Monofilament yarns, as are used in the current invention, typically have a smooth surface profile with very little surface area to which the cementitious material may adhere. In addition, cementitious material is typically hydrophilic, which further affects adhesion to polypropylene, which is hydrophobic. One way to combat these problems is with fabric construction. An open construction, for example, provides spaces between adjacent yarns through which the cementitious material may flow. Further, the fabric construction provides points of yarn overlap (yarn interstices), where the cement can nest and provide mechanical adhesion between the cementitious material and the reinforcement scrim or fabric.

In some instances, a fabric with a closed construction (that is, one in which adjacent parallel yarns are touching) may be preferred. It is contemplated that a more closed construction will provide greater mechanical reinforcement of the cementitious article, as compared with scrim fabrics. Both fabrics, in general, and scrims, in specific, provide reinforcement by distributing forces applied to the cementitious article over a greater area.

In a first embodiment (shown in FIG. 1), the reinforcement fabric is a bi-directional fabric or scrim substrate including a plurality of lateral weft yarns that intersect a plurality of warp yarns at right angles. The fabric may be held together by frictional forces, as in a woven fabric. Optionally, the warp yarns and weft yarns may be bonded at their intersections by an adhesive composition, as in an adhesively bonded laid scrim. Another option is that the yarns may be held together at their intersections with a knit stitch, such as is used in a weft-inserted warp knit fabric. Additionally, these fabrics could be produced via a multi-ply laminate construction in which warp warns are adhered to weft yarns by an adhesive web, adhesive film, or by the use of a non-woven adhesive carrier (e.g., as in a cross-plied material).

As illustrated in FIG. 1, reinforcement fabric 20 is a bi-directional scrim that includes a layer of parallel weft yarns 26 and a layer of parallel warp yarns 28 as may be obtained by weaving, warp knitting, cross-plying, stitch-bonding, or adhesively bonding the yarns.

A number of woven constructions are envisioned including plain weaves, leno weaves, twills, satins, and others depending on the bias direction stability required and any restriction on warp or weft crimp. Optionally, these yarns may be held together by an adhesive, such as polyvinyl alcohol (PVOH), acrylic, polyvinyl acetate, polyvinyl chloride, polyvinylidiene chloride, polyacrylate, acrylic latex, styrene butadiene rubber (SBR), ethylene vinyl acetate (EVA), plastisol, or any other suitable adhesive. These yarns optionally could be thermally bonded to form the reinforcement fabric. Also, the warp and weft yarns could be attached at their intersection points with a knit stitch, such as would be obtained with a weft-inserted warp knit fabric. A variety of stitches or stitch configurations could be used depending on the stability requirements.

In the preferred fabric construction, warp yarns 28 comprised of high modulus polypropylene monofilaments are disposed at approximately 4 to 25 ends per inch, and weft yarns 26 comprised of high modulus polypropylene monofilaments are disposed at approximately 4 to 25 ends per inch. A more preferred fabric construction is 6 to 20 ends per inch in the warp and weft directions, and a most preferred construction is 8 to 15 ends per inch. Further, the high modulus monofilament warp yarns 28 and weft yarns 26 are preferably in the denier range of 150 to 2000 denier per filament, more preferably in the denier range of 500 to 1200 denier per filament, and most preferably in the 500 to 800 denier per filament range. It is contemplated that the denier of warp yarn 28 and/or weft yarn 26 (whether monofilament, spun or multifilament) and the number of warp yarns 28 and/or weft yarns 26 per inch can be increased or decreased as necessary to meet the strength and modulus requirements of the finished cement panel 10.

The bi-directional scrim can be formed from two layers of single ply yarns that are laid at right angles to each other. Each single ply of monofilament yarns is individually laid on a carrier sheet such as a film, nonwoven, foil, or fabric. The single ply sheets are then positioned at right angles to each other and secured to form the bi-directional fabric.

Optionally, the weft yarn can be mechanically laid, using an automated yarn distribution system, onto a sheet of warp yarns, where the weft yarns are adhesively or thermally bonded to the warp yarns.

For many of the fabric formations described herein, it is understood that the monofilament yarn may be difficult to incorporate into a fabric construction, especially when the monofilament is exposed to twist. To mitigate this problem, roll-off creels for warp yarns and roll-offs for weft yarn incorporation may be required, when using the high modulus monofilament yarns in either the warp or weft or both.

In a second embodiment (shown in FIG. 2), the reinforcement fabric is a tri-directional, also commonly referred to as "triaxial," scrim fabric that is optionally held together by an adhesive composition, as in an adhesively bonded laid scrim. Alternatively, the scrim fabric can be held together by a knit stitch, as in a multi-axial warp knit. In a triaxial scrim, plural weft yarns having both an upward diagonal slope and a downward diagonal slope as well as plural longitudinal warp yarns. Cross-plied materials can be triaxial as well.

Figure 2:
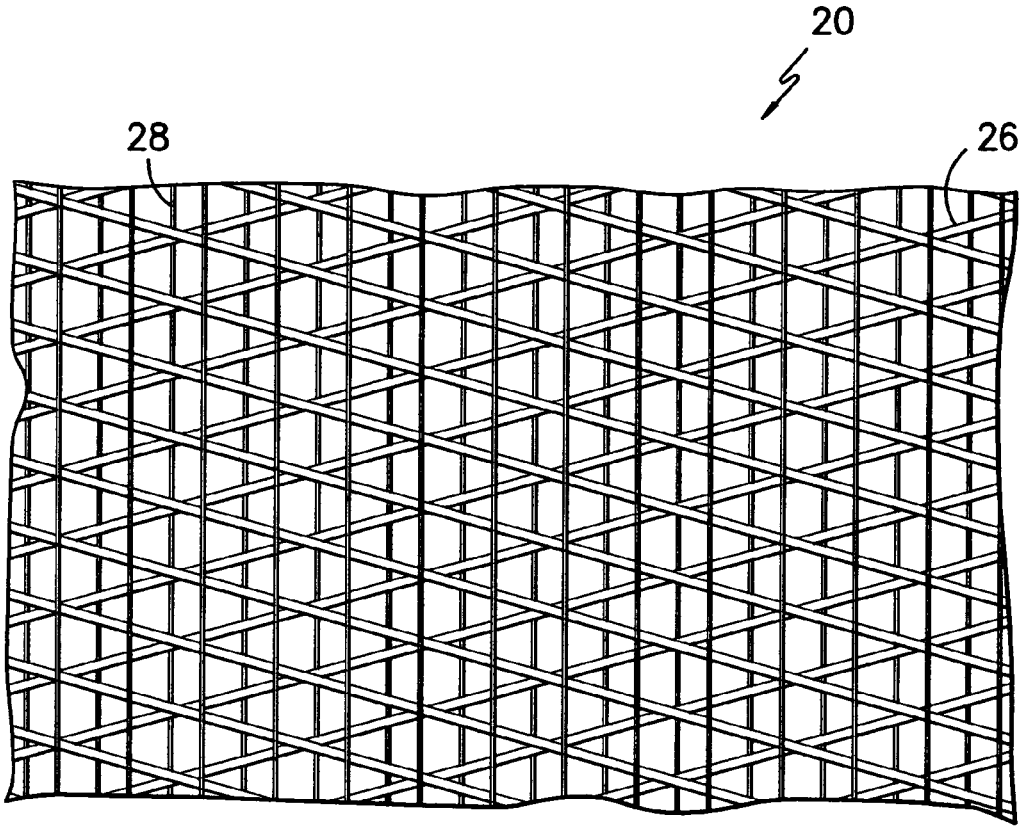
FIG. 2 is a top view of a tri-axial reinforcement fabric for use in combination with cement panels according to an alternative embodiment contemplated herein.

FIG. 2 illustrates reinforcement fabric 20 according to a second embodiment. As shown, reinforcement fabric 20 is a tri-directional, or triaxial, scrim fabric that may be woven, knit, or held together by an adhesive composition, such as those described above with reference to FIG. 1, or by thermal bonding. Similar to the first embodiment (shown in FIG. 1), the optional adhesive coating of reinforcement fabric 20 is dried upon application to stabilize reinforcement fabric 20. Additionally, thermal bonding may be used.

In a triaxial construction, there are three sets of yarns: two sets of weft yarns 26, a first set having both an upward diagonal slope and a second set having a downward diagonal slope, and a set of longitudinal warp yarns 28 that may be located on top of the first set of weft yarns 26 and below the second set of weft yarns 26. The preferred range of the fabric construction of triaxial reinforcement fabric 20 is between approximately 4×2×2 (4 ends per inch in the warp direction, 2 ends per inch on the upward diagonal slope in the weft direction, and 2 ends per inch on the downward diagonal slope in the weft direction) and 18×9×9, and is most preferably between 6×3×3 and 12×6×6. Further, the high modulus monofilament warp yarns 28 and weft yarns 26 are preferably in a denier range of 150 to 2000 denier per filament, more preferably in the range of 500 to 1000 denier per filament, and most preferably in the range of 500 to 800 denier per filament.

Also suitable for use herein are multi-axial knit fabrics. Alternatively, stitch-bonded fabrics, with weft yarns between 8 and 50 ends per inch, and warp yarns between 3 and 18 ends per inch, can attach directly to a nonwoven facing sheet.

In a third embodiment (not shown), the reinforcement fabric may comprise stitch-bonded fabrics, such as those produced on a Malimo Machine. A stitch-bonded fabric is a composite nonwoven fabric formed by various methods of stitching through unconnected fibers, using techniques such as quilting or interlacing with fine mesh to hold the construction together. In these instances, the weft yarns do not necessarily form a regular right angle to the weft yarns. The weft yarns may, for instance, be knit-stitched to a carrier substrate such as a nonwoven fabric.

It is anticipated that any of the preceding reinforcement fabrics could be attached to an additional facer material to form a composite. The additional facer material could, for instance, be a nonwoven fabric, a film, a foil, or another fabric layer. The nonwoven fabric may be comprised of polyolefin, polyester, nylon, fiberglass, or other materials known in the art. The facer material may be used to enhance bonding between reinforcement and cement, to provide additional crack resistance, to provide a smooth surface, to provide flame retardance, to create a moisture barrier, to provide insulative properties, to create a printable surface, or to provide any other desirable attributes of a surface layer. It is contemplated that the high modulus polypropylene reinforcement scrim could be combined in a reinforcing composite with other reinforcement fibers or fabrics or be used in combination with other reinforcement fibers, fabrics, or other materials in the final reinforced article.

Preferably, whether using a biaxial or triaxial or multi-axial construction for fabric 20, both warp yarns 28 and weft yarns 26 are principally of high modulus polypropylene fibers. Alternatively, only warp yarns 28 or weft yarns 26 of reinforcement fabric 20 are made of high modulus polypropylene monofilament fibers, and the corresponding weft yarns 26 or warp yarns 28 are made of fibers such as polyester, polyamides, polyolefin, ceramic, nylon, fiberglass, basalt, carbon, and aramid and may be monofilament, multifilament or spun yarns of appropriate denier.

In another alternative embodiment, the yarns in both the warp and weft direction could include alternating yarns made of high modulus polypropylene fiber and a second fiber such as those listed above. As used herein, the term "alternating" includes any combination of high modulus polypropylene fibers with a second fiber, including (a) multiple high modulus polypropylene fibers next to multiple second fibers, (b) a single high modulus polypropylene fiber next to a single second fiber, (c) multiple high modulus polypropylene fibers next to single second fibers, and (d) single high modulus polypropylene fibers next to multiple second fibers.

As previously discussed, the use of high modulus polypropylene monofilament fibers to make reinforcement fabric 10 is a particular feature of the present reinforced cementitious articles. The use of high modulus polypropylene fibers—preferably for both warp yarns 28 and weft yarns 26—provides an economical reinforcement that minimizes or eliminates the need for a protective coating over reinforcement fabric 20 as would be required for fiberglass or steel. Because of its chemical nature, polypropylene is unaffected by alkali conditions, while similar uncoated glass fibers would quickly degrade and lose their physical property advantages, and steel would be susceptible to corrosion. Further, high modulus monofilament polypropylene provides high strength, high modulus of elasticity, and low weight. Finally, when nucleated, the resulting polypropylene has improved high temperature shrinkage characteristics as compared to non-nucleated polypropylene, and exhibits a lesser degree of thermal degradation during the curing phase of the cement panels. However, non-nucleated high modulus monofilament polypropylene yarns are generally of lower shrinkage than non-nucleated lower modulus monofilament polypropylene yarns.

Figure 3:
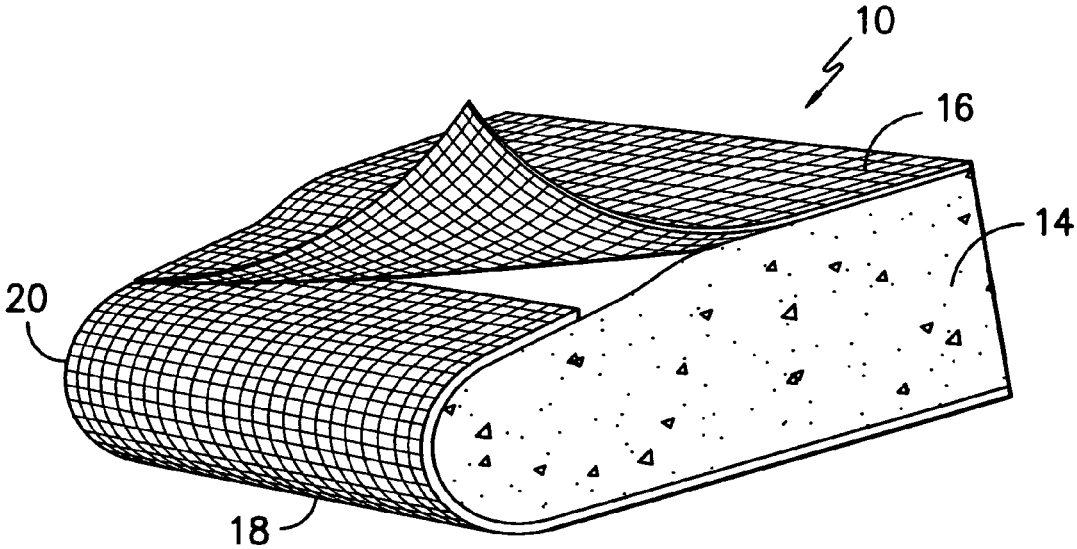
FIG. 3 is a perspective view of a reinforced cement panel according to one embodiment contemplated herein.

As has been described, the present disclosure is directed generally to cementitious articles 10 that are reinforced with a high modulus fabric 20, such as may be made from high modulus monofilament polypropylene yarns. One example, as shown in FIG. 3, is a cement article 10 includes a core layer 14 that is made of a cementitious composition. In the embodiment shown, core layer 14 is covered by a top layer 16 and a bottom layer 18 of reinforcement fabric 20.

Optionally the two reinforcement layers may be embedded in the board and closer to the center. Depending on the mode of force imparted to the article, perhaps only one layer of the high modulus monofilament polypropylene fabric would be necessary. If reinforcement was only needed in one direction for the composite, say the longitudinal axis, then the high modulus polypropylene monofilament yarns might only need to be in one important direction (for example, the longitudinal axis).

Preferably, for a cement panel, top layer 16 and bottom layer 18 of fabric 20 overlap on the edge region of cement panel 10. Because of its cementitious nature, a cement board or panel tends to be relatively brittle at its edges, which often serve as points of attachment for the boards. Accordingly, by overlaying the fabric 20 at these regions, the strength of the cement board edges is augmented, and the boards retain sufficient structural integrity to remain attached when installed. In such cases (as shown) where reinforcement fabric 20 is bent to conform to the shape of the cementitious article, it is advantageous to use polypropylene yarns, which are able to take a crease and to maintain it over time.

Figure 4:
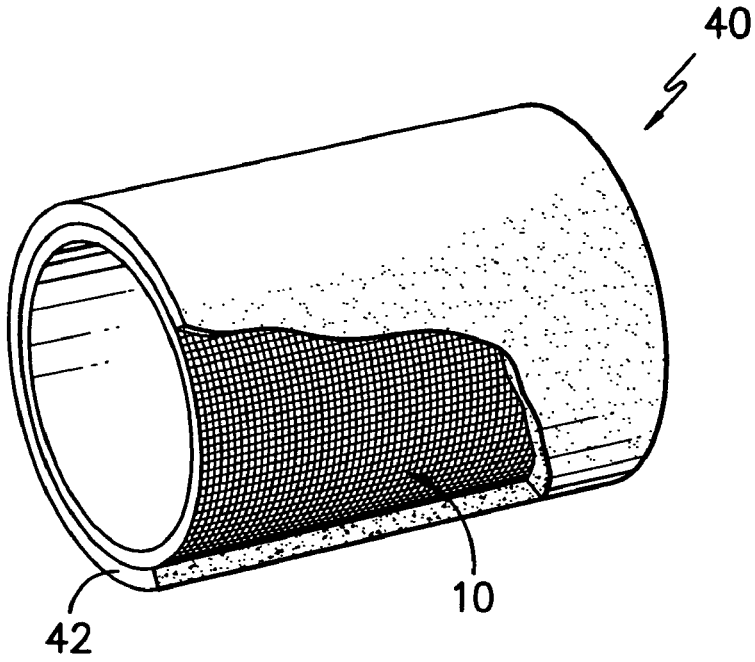
FIG. 4 is a perspective view of a cylindrical reinforced cement vessel, according to the teachings of the present disclosure.

FIG. 4 shows a cylindrical cementitious article 40, such as a tank. A similar construction may also be used for other cylindrical vessels, such as a pipe. In this embodiment, reinforcement fabric 10, positioned centrally within the cementitious wall 42 of the vessel, provides impact resistance and tensile strength, as well as resistance to spalling of the surface (as might occur if additional steel reinforcements are used in cementitious article 40). It is contemplated that two layers of reinforcement fabric 10 could be used instead of the one layer shown, with a first layer being positioned toward the inside of the vessel and a second layer being positioned toward the outer periphery of the vessel.

Figure 5:
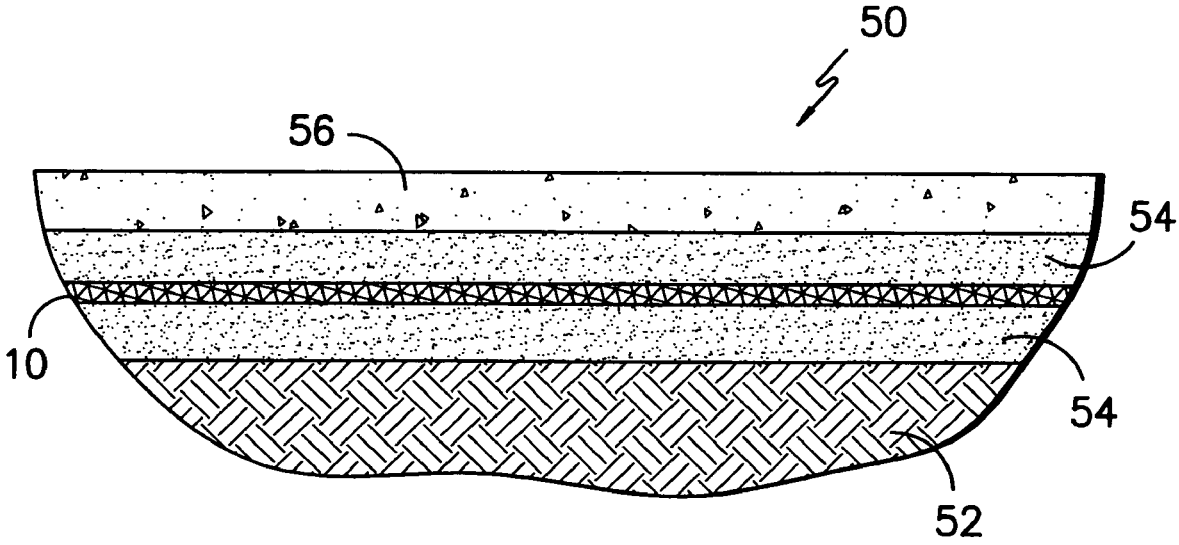
FIG. 5 is a perspective view of a reinforced cementitious roadway as contemplated herein.

FIG. 5 shows a representative example of reinforcement fabric 10 for use in a cementitious, or asphaltic, roadway 50. In this embodiment, reinforcement fabric 10 is positioned between two layers of sand or dirt 54. It is contemplated that a granular material (such as gravel, rock, or recycled material) 52 may be used as the base of roadway 50. The surface of roadway 50, as described herein, is comprised of a cementitious or asphaltic material 56.

Fiber, Yarn, Fabric and Article Production and Physical Analyses

The following non-limiting examples are indicative of preferred embodiments of the present disclosure.

EXAMPLE #1

High Modulus Monofilament Yarns

Production

The objective of this Example was to produce a number of high modulus yarns, either with or without a nucleating agent, and to evaluate the effect of draw ratio on the physical properties (for example, modulus of elasticity) of the resulting yarns.

A polypropylene resin (Atofina 3462) with a Melt Flow Index of 4 was used for these Examples. Selected samples (as detailed in TABLE 1A) included a nucleating agent that was added during extrusion of the monofilament yarns.

For Examples 19a-23a, a nucleating agent was incorporated into a 10% concentration masterbatch, which was produced by mixing 1,3:2,4-bis(3,4-dimethylbenzylidene) sorbitol (3,4-DMDBS) in powder form with a powdered polypropylene carrier resin in a high speed mixer. The mixture was extruded through a twin-screw extruder at an extruder temperature of 240° C. and cut into pellets, which were processed as described below.

The polypropylene pellets, some of which included an additive nucleator, were melted and then extruded using a single screw extruder through monofilament spinnerets with 60 holes. The polypropylene melt through-put was adjusted to give a final monofilament denier of approximately 520 g/9000 m.

The molten strands of filament were quenched in room temperature water (about 25° C. or 77° F.), and then transferred by rollers to a battery of air knives, which removed surface water from the filaments. The filaments were then run across the first of two sets of large rolls, all rotating at a speed of between 35 and 160 ft/min (10.7 m/min and 48.8 m/min), dependent on draw ratio, before entering an approximately 14-foot long oven set to a temperature of either 270° F. or 340° F. (132° C. or 171° C.).

After leaving the first oven, the filaments were transferred to the second set of large rollers running at a speed of 630 ft/min (192.0 m/min). The individual monofilament fibers were then traversed to winders where they were individually wound. These final fibers are thus referred to as the polypropylene monofilaments.

Many monofilament fibers were made in this manner, adjusting the polypropylene resin and the draw ratio (rotational speed ratio between the first and second sets of rolls). The processing conditions are described in TABLE 1A below.

TABLE 1A

Monofilament Processing Conditions

| | Roll Speed (ft/min) | | Oven Temperature | DBS Loading | |
|---|---|---|---|---|---|
| Sample ID | Roll 1 | Roll 2 | (° F.) | (ppm) | Draw Ratio |
| NON-NUCLEATED POLYPROPYLENE MONOFILAMENTS | | | | | |
| 1a | 158 | 630 | 270 | 0 | 4:1 |
| 2a | 126 | 630 | 270 | 0 | 5:1 |
| 3a | 105 | 630 | 270 | 0 | 6:1 |
| 4a | 90 | 630 | 270 | 0 | 7:1 |
| 5a | 78 | 630 | 270 | 0 | 8:1 |
| 6a | 70 | 630 | 270 | 0 | 9:1 |
| 7a | 63 | 630 | 270 | 0 | 10:1 |
| 8a | 90 | 630 | 340 | 0 | 7:1 |
| 9a | 79 | 630 | 340 | 0 | 8:1 |
| 10a | 70 | 630 | 340 | 0 | 9:1 |
| 11a | 63 | 630 | 340 | 0 | 10:1 |
| 12a | 57 | 630 | 340 | 0 | 11:1 |
| 13a | 53 | 630 | 340 | 0 | 12:1 |
| 14a | 48 | 630 | 340 | 0 | 13:1 |
| 15a | 45 | 630 | 340 | 0 | 14:1 |
| 16a | 42 | 630 | 340 | 0 | 15:1 |
| 17a | 39 | 630 | 340 | 0 | 16:1 |
| 18a | 37 | 630 | 340 | 0 | 17:1 |
| NUCLEATED POLYPROPYLENE MONOFILAMENTS | | | | | |
| 19a | 48 | 630 | 340 | 2000 | 13:1 |
| 20a | 45 | 630 | 340 | 2000 | 14:1 |
| 21a | 42 | 630 | 340 | 2000 | 15:1 |
| 22a | 39 | 630 | 340 | 2000 | 16:1 |
| 23a | 37 | 630 | 340 | 2000 | 17:1 |

Testing

These monofilament fibers were tested for tensile properties using an MTS Sintech 10/G instrument at least 24 hours after production.

They were also tested for shrinkage in an FST 3000 shrinkage tester available from Lawson-Hemphill with the heater plates set to 275° F. (135° C.) and a suspended weight of 8 g. Shrinkage was calculated as the average shrinkage of five samples compared in relation to the initial lengths before heat exposure.

All of these results are reported in the TABLE 1B below for different fibers (with the denier measured in g/9000 m).

TABLE 1B

Physical Properties of Specified Monofilaments

| Sample ID | Denier (g/9000 m) | Elongation (%) | Tenacity (g/denier) | 1% Modulus (g/denier) | 3% Modulus (g/denier) | 135° C. Shrinkage (%) |
|---|---|---|---|---|---|---|
| NON-NUCLEATED POLYPROPYLENE MONOFILAMENTS | | | | | | |
| 1a | 521 | 21.7 | 3.3 | 55 | 36 | 7.6 |
| 2a | 516 | 19.9 | 4.2 | 65 | 44 | 11.9 |
| 3a | 515 | 20.8 | 5.8 | 82 | 55 | 16.4 |
| 4a | 522 | 17.9 | 6.5 | 88 | 61 | 18.3 |
| 5a | 522 | 14.6 | 7.4 | 106 | 75 | 20.6 |
| 6a | 524 | 9.8 | 6.2 | 112 | 82 | 19.6 |
| 7a | 524 | 8.2 | 6.2 | 126 | 95 | 16.5 |
| 8a | 521 | 17.0 | 5.9 | 68 | 50 | 9.2 |
| 9a | 520 | 11.9 | 5.6 | 82 | 61 | 10.7 |
| 10a | 513 | 9.8 | 5.8 | 100 | 75 | 12.2 |
| 11a | 518 | 8.3 | 5.9 | 113 | 86 | 12.2 |
| 12a | 523 | 6.9 | 5.9 | 133 | 103 | 10.3 |
| 13a | 520 | 6.0 | 5.6 | 142 | 114 | 7.8 |
| 14a | 528 | 7.4 | 7.3 | 146 | 123 | 7.6 |
| 15a | 525 | 6.9 | 7.4 | 156 | 132 | 6.3 |
| 16a | 520 | 6.9 | 8.2 | 172 | 147 | 5.1 |
| 17a | 520 | 6.4 | 8.1 | 169 | 152 | 4.3 |
| 18a | 524 | 6.4 | 8.6 | 181 | 163 | 3.7 |
| NUCLEATED POLYPROPYLENE MONOFILAMENTS | | | | | | |
| 19a | 516 | 7.5 | 7.1 | 141 | 118 | 5.1 |
| 20a | 514 | 7.7 | 7.7 | 147 | 126 | 4.6 |
| 21a | 513 | 6.8 | 7.6 | 157 | 136 | 4.1 |
| 22a | 524 | 6.6 | 7.7 | 157 | 141 | 3.7 |
| 23a | 519 | 5.8 | 7.6 | 167 | 152 | 3.2 |

In these experimental trials samples 7a and 12a-23a exhibited properties of overdrawing, as evidenced by the clear polypropylene turning opaque and the occurrence of microfibrilation along the length of the fibers. For purposes of discussion herein, Samples 12a-23a are considered "high modulus" yarns.

EXAMPLE #2

Ultra-High Modulus Monofilament

Production

An at-level compounded nucleated polypropylene resin was produced by blending powdered 1,3:2,4-bis(3,4-dimethylbenzylidene) sorbitol (3,4-DMDBS) nucleator compound with powdered polypropylene resin with a Melt Flow Index of 4 (AtoFina 3462) in a high speed mixer at a 2500 ppm concentration. The mixture was extruded through a twin-screw extruder at an extruder temperature of about 464° F. (240° C.) and cut into pellets. These nucleated pellets, consisting of polypropylene resin and the additive nucleator, were melted and then extruded using a single screw extruder through monofilament spinnerets with 60 holes. The polypropylene melt through-put was adjusted to give a final monofilament denier of approximately 520 g/9000 m.

The molten strands of filament were quenched in room temperature water (about 25° C. or 77° F.) and then transferred by rollers to a battery of air knives, which removed surface water from the filaments. The filaments were then run across the first of four sets of large rolls, all rotating at a speed of about 44 ft/min (13.4 m/min), before entering an approximately 14-foot long oven set to a temperature of 350° F. (177° C.).

After leaving the first oven, the filaments were transferred to the second set of large rollers running at a speed of about 520 ft/min (158.5 m/min) and then into second oven, set at a temperature of 395° F. (202° C.). The third sets of rolls were set at 590 ft/min and the third oven between them was set at a temperature of 395° F. (202° C.). The final (fourth) set of rolls was set at a speed of 630 ft/min (192.0 m/min) for a total overall draw ratio of 14.3. The individual monofilament fibers were then traversed to winders where they were individually wound. These final fibers are thus referred to as the polypropylene monofilaments.

Testing

The polypropylene monofilament fibers produced by this method were tested for tensile properties using an MTS Sintech 10/G instrument.

This sample was also tested for shrinkage in an FST 3000 shrinkage tester available from Lawson-Hemphill with the heater plates set to 243° F. (117° C.) (which give an actual temperature of 275° F., or 135° C.) and with a suspended weight of 8 g. Shrinkage was calculated as the average shrinkage of five samples compared in relation to the initial lengths before heat exposure.

The nucleator concentration of the monofilament fiber was also measured by gas chromatography.

The results of the physical testing are as follows in TABLE 2.

TABLE 2

Physical Properties of Specified Monofilament Fiber

| Sample ID | Denier (g/9000 m) | Elongation at Break (%) | Tenacity (g/denier) | 1% Modulus (g/denier) | 3% Modulus (g/denier) | 135° C. Shrinkage (%) |
|---|---|---|---|---|---|---|
| 1A | 520 | 5.4 | 6.8 | 190 | 150 | 4.7 |

The resulting yarn produced according to the method described herein has a 3% secant modulus of elasticity of 150 g/denier, qualifying it as a "high modulus" yarn.

EXAMPLE #3

Ultra-High Modulus Monofilament Fabric

Production

The ultra-high modulus monofilament yarn produced in Example 2 was used to generate a woven fabric by first loading the spools of yarn into a roll-off warper creel. The yarn was then warped onto section beams. The section beams were re-beamed onto a loom beam using a re-beaming machine. A fabric was made in a plain weave construction on a Rigid Rapier Weave machine. The fabric construction was approximately 13 ends per inch (in the warp direction) by 15 picks per inch (in the weft direction).

Testing

Tensile tests, performed as prescribed by ASTM D1682, had a warp direction breaking force of 89 pounds, and a weft direction breaking force of 111 pounds, with elongations of 9.5% and 8.5%, respectively. Additionally, the fabric itself was subjected to three different tests of alkali resistance. The first test exposed the fabric to a 1 N NaOH solution at room temperature for 30 minutes, after which the fabric was patted dry and retested by the ATSM D1682 prescribed method. The second alkali test was similar to the first, except the fabric was exposed to a 1% NaOH solution for 4 hours, then dried, and retested. The third test exposed the fabric to a trihydroxy solution of 3000 g distilled water, 84 g NaOH, 252 KOH, and 11.1 CaOH for 24 hours at 104° F. (40° C.), after which the fabric was patted dry and further dried in a hot air oven for 4 hours at 176° F. (80° C.). Each test was performed with 5 replicates in both the warp and fill direction. The results of the first two tests are shown below in TABLE 3.

TABLE 3

Tensile Testing of Ultra-High Modulus Monofilament Fabric

| Treatment | Warp Peak Load (lb) | Warp Elongation at Peak Load | Fill Peak Load (lb) | Fill Elongation at Peak Load |
|---|---|---|---|---|
| None | 91.15 +/− 3.37 | 5.770 +/− 0.249 | 112.02 +/− 1.63 | 5.502 +/− 0.144 |
| 1N NaOH (30 minutes) | 88.23 +/− 2.24 | 9.051 +/− 0.101 | 114.75 +/− 3.11 | 8.184 +/− 0.330 |
| 1% NaOH (3 hours) | 89.40 +/− 4.27 | 8.895 +/− 0.621 | 115.34 +/− 0.59 | 8.318 +/− 0.102 |

The fabric samples subjected to each of these tests experienced less than 5% strength loss (ASTM D1682) and, in the vast majority, no physical property loss was observed.

Thus, the present fibers exhibited excellent high modulus levels, as well as low shrinkage rates, in addition to excellent alkaline resistance characteristics that have heretofore been simultaneously unattainable for monofilament thermoplastic fibers.

EXAMPLE #4

Cementitious Boards

Production

For the cementitious matrix, Type III Portland Cement from Lafarge North America was used. In addition, three types of lightweight additives were used in different mix designs. Their characteristics are summarized in TABLE 4A.

TABLE 4A

Lightweight Aggregate Characteristics

| Name | Density (g/cm$^3$) | Average Particle Size | Particle Size Distribution |
|---|---|---|---|
| NOR-CAL Perlite | 4.4 | N/A | N/A |
| Siscor glass spheres | 16.2 | N/A | 500-1000 μm |
| Sil-Cell 32 | 7 | 75 μm | 1-300 μm |

Pastes were prepared according to ASTM Standard C 305-82 according to the following mixes: (a) control pastes at water/cement of 0.30 and 0.35; (b) pastes with lightweight aggregate at both water/cement ratios; and (c) replacement of original cement (quantity contained in the control pastes) by volume with 40%, 50% and 60% of lightweight aggregates. The mixes were then cast into 2-inch cubes, and the density of the mix was determined by comparing the weight of the cubes in atmospheric conditions and their weight when submerged in water. All the mixes were compared to the densities of the control pastes. Control pastes have a density of approximately 120 to 130 lb/ft$^3$, and the desired density of the paste was approximately 90 lb/ft$^3$. The results from the density measurements done on samples with 40% and 50% cement replacement by volume with lightweight material were still substantially higher than the 90 lb/ft$^3$ objective. The results closest to the 90 lb/ft$^3$ objective were obtained with the Sil-Cell 32 perlite powder at 60% replacement by volume at a water/cement ratio of 0.35 (specifically, a density of 1.52 g/cm$^3$ (93.56 lb/ft$^3$)).

Using the cement mix with 60% replacement by volume with Sil-Cell 32 perlite, boards were produced using a 3 ft×5 ft plywood mold. A first layer of the fabric of Example 3 was secured to one side of the mold and then pulled taut and secured to the second side of the mold with wood strips of ⅜ inch thickness. The paste of density 1.52 g/cm$^3$ was then poured over the secured fabric in two stages until it was ⅜ inch high. At that time, a second fabric layer was secured taut with a ⅛ inch strip of wood on all 4 sides of the mold and a final layer of paste was poured and smoothed so that the final board thickness was ½ inch. While the paste was still fresh, a plastic sheet was placed over it to prevent evaporation. After 24 hours, the entire board was completely covered with wet burlap and the whole assembly was covered with plastic to maintain an adequate humidity level. Two boards were produced in this manner: one board reinforced with the ultra high modulus polypropylene monofilament fabric of Example 3 and a second board reinforced with a comparative PVC coated glass fabric of 10 warp yarns per inch and 10 weft yarns per inch. The glass yarns were G-75 yarns, which gave the fabric a tensile strength of about 100 pounds in the warp and fill directions and an which had an elongation at break of about 3%. The two boards were removed from their molds after 10 days of curing at room temperature.

Testing

The first test performed on each of the boards was to determine if the full 3 ft×5 ft boards supported their own weight. Each of the polypropylene ultra-high modulus monofilament boards and the glass board were lifted. The test was as follows:

Step 1. Lift board as cast with two persons lifting at opposite ends of the 5-foot span;

Step 2. Flip board so the underside as cast is facing upward;

Step 3. Flip board a second time to as-cast position; and

Step 4. Lower board back into form.

After step 1, all three of the boards remained intact. After step 2, micro-cracking was observed in both samples. All of the boards supported their own weight when lifted.

The second test was a three-point bend. This test was performed on 5 samples from each of the boards. The specimens were 7 inches long and 2 inches wide. This allows a main span of 6 inches for the samples between the two outer supports of the test apparatus. The load is applied at the mid-point of the specimen across its entire width. The mid-point deflection is monitored with an extensometer. The modulus of elasticity was calculated from beam theory for a supported beam with a concentrated load applied at mid-span from the following equations:

$$E=(P/\delta)L^3/48I$$

Where E is the Modulus of Elasticity, (P/δ) is the initial slope of the stress-strain curve obtained during the testing, L is the span of the beam between supports, and $I=bh^3/12$ for a beam with rectangular cross section of width b and height h. The results from the tested specimens are detailed in TABLE 4B.

TABLE 4B

| Modulus of Elasticity | | |
|---|---|---|
| Sample ID | Fabric Type | E (GPa) |
| C1 | Polypropylene | 9.17 |
| C2 | Polypropylene | 8.73 |
| C3 | Polypropylene | 7.57 |
| C4 | Polypropylene | 9.86 |
| C5 | Polypropylene | 7.45 |
| D1 | PVC Coated Glass | 6.96 |
| D2 | PVC Coated Glass | 7.32 |
| D3 | PVC Coated Glass | 6.66 |
| D4 | PVC Coated Glass | 8.47 |
| D5 | PVC Coated Glass | 9.41 |

Therefore, the boards reinforced with high modulus polypropylene possessed moduli of elasticity higher on the average than the glass reinforced boards. The woven polypropylene fabric was not coated with any protective layers, unlike the glass fabric that was coated with PVC.

As a final evaluation, the boards were subjected to a nailing test. 2 inch×7 inch sections of board were cut from each the polypropylene- and glass-reinforced cementitious boards. The test used a modified Charpy apparatus to punch a nail through the section of board. A load cell at the tip of the pendulum and two additional load cells placed behind the specimen measured the forces of impact. For each board, four samples were tested. Peak load and energy to nail were measured for each sample and are reported in TABLE 4C.

TABLE 4C

| Nailing Test Data | | | |
|---|---|---|---|
| Sample ID | Fabric Type | Peak Load (lb) | Energy (lb · ft) |
| C6 | Polypropylene | 344 | 2.47 |
| C7 | Polypropylene | 256 | 1.598 |
| C8 | Polypropylene | 328 | 4.125 |
| D9 | Polypropylene | 320 | 2.018 |
| D6 | PVC Coated Glass | 168 | 1.791 |
| D7 | PVC Coated Glass | 208 | 2.231 |
| D8 | PVC Coated Glass | 208 | 1.419 |
| D9 | PVC Coated Glass | 232 | 2.077 |

Analysis of the back of each of these boards, after the nail impacted, demonstrate that a larger amount of cement was ejected from the back of the glass reinforced boards during nail impact. This indicates that the polypropylene reinforcement imparts improved impact resistance to the boards as well.

Those skilled in the art of cementitious articles will recognize that many substitutions and modifications can be made in the foregoing preferred embodiments without departing from the spirit and scope of the present invention.

We claim:

1. A reinforced cementitious article, said article being reinforced by at least one layer of fabric selected from the group consisting of a bi-directional fabric and a multi-directional fabric, said fabric layer comprising at least some continuous high modulus polypropylene yarns having a 3% secant modulus of elasticity of at least 100 grams per denier wherein said continuous high modulus polypropylene yarns comprises polyethylene in an amount of no more than 10%.

2. A reinforced cementitious article, said article being reinforced by at least one layer of fabric, selected from the group consisting of a bi-directional fabric and a multi-directional fabric, said fabric layer comprising at least some continuous high modulus polypropylene monofilament yarns having a 3% secant modulus of elasticity of at least 100 grams per denier wherein said continuous high modulus polypropylene yarns comprises polyethylene in an amount of no more than 10%.

3. The reinforced article of claim 2, wherein said continuous high modulus polypropylene monofilament yarns have a 3% secant modulus of elasticity of at least 120 grams per denier.

4. The reinforced article of claim 3, wherein said continuous high modulus polypropylene monofilament yarns have a 3% secant modulus of elasticity of at least 150 grams per denier.

5. The reinforced article of claim 2, wherein said fabric is a bi-directional fabric selected from the group consisting of woven fabrics, warp knit fabrics, weft-inserted warp knit fabrics, cross-plied fabrics, stitch-bonded fabrics, adhesively bonded fabrics, and thermally bonded fabrics.

6. The reinforced article of claim 2, wherein said fabric is a bi-directional scrim.

7. The reinforced article of claim 6, wherein said bi-directional scrim has a woven construction selected from the group consisting of plain weaves, leno weaves, twills, and satins.

8. The reinforced article of claim 6, wherein said bi-directional scrim comprises between 4 and 25 warp yarns per inch and between 4 and 25 weft yarns per inch.

9. The reinforced article of claim 8, wherein said bi-directional scrim comprises between 6 and 20 warp yarns per inch and between 6 and 20 weft yarns per inch.

10. The reinforced article of claim 9, wherein said bi-directional scrim comprises between 8 and 15 warp yarns per inch and between 8 and 15 weft yarns per inch.

11. The reinforced article of claim 2, wherein said fabric is a multi-directional fabric selected from the group consisting of multi-axial warp knit fabrics, tri-directional woven fabrics, cross-plied fabrics, stitch-bonded fabrics, adhesively bonded fabrics, and thermally bonded fabrics.

12. The reinforced article of claim 6, wherein said bi-directional scrim comprises warp yarns and fill yarns, said warp yarns having a denier in the range of 150 denier to 2000 denier and said weft yarns having a denier in the range of 150 denier to 2000 denier.

13. The reinforced article of claim 12, wherein said warp yarns have a denier in the range of 500 denier to 1200 denier and said weft yarns have a denier in the range of 500 denier to 1200 denier.

14. The reinforced article of claim 13, wherein said warp yarns have a denier in the range of 500 denier to 800 denier and said weft yarns have a denier in the range of 500 denier to 800 denier.

15. The reinforced article of claim 6, wherein said bi-directional scrim comprises warp yarns and weft yarns, and wherein only one of said warp and said weft comprise said continuous high modulus polypropylene monofilament yarns having a 3% secant modulus of elasticity of at least 100 grams per denier.

16. The reinforced article of claim 6, wherein said bi-directional scrim comprises warp yarns and weft yarns, and wherein said continuous high modulus polypropylene monofilament yarns having a 3% secant modulus of elasticity of at least 100 grams per denier are present in only one direction and yarns of a different type are present in an opposing direction, said yarns in the opposing direction having a type selected from the group consisting of polyesters, polyamides, polyolefins, ceramic, nylon, fiberglass, basalt, carbon, aramid, steel, PVA, and combinations thereof.

17. The reinforced article of claim 6, wherein said bi-directional scrim has warp yarns and weft yarns, and wherein at least one of said warp and said weft comprise an alternating pattern of continuous high modulus polypropylene monofilament yarns having a 3% secant modulus of elasticity of at least 100 grams per denier and yarns having a type selected from the group consisting of polyesters, polyamides, polyolefins, ceramic, nylon, fiberglass, basalt, carbon, aramid, steel, PVA, and combinations thereof.

18. The reinforced article of claim 2, wherein said fabric is a tri-directional scrim.

19. The reinforced article of claim 18, wherein said tri-directional scrim has a construction between 4×2×2 and 18×9×9.

20. The reinforced article of claim 19, wherein said tri-directional scrim has a construction between 6×3×3 and 12×6×6.

21. The reinforced article of claim 2, wherein said article being reinforced is selected from the group consisting of panels, boards, precast slabs, flat slabs, columns, constant cross-section articles, prestressed concrete, structural members, decorative members, cementitious flooring, countertops, poured cementitious foundations, cementitious walls, exterior installation and finish systems, roofing tile and decking systems, and cementitious roadways.

22. The reinforced article of claim 21, wherein said article being reinforced is a cement panel.

23. The reinforced article of claim 2, wherein at least two layers of fabric are present.

24. The reinforced article of claim 2, wherein said continuous high modulus polypropylene monofilament yarns have an elongation of at least 3%.

25. The reinforced article of claim 1, wherein said continuous high modulus polypropylene yarns include a round cross section.

26. The reinforced article of claim 1, wherein said continuous high modulus polypropylene yarns include an elongated rectangular cross section.

27. The reinforced article of claim 1, wherein said continuous high modulus polypropylene monofilament yarns are taped yarns.

28. The reinforced article of claim 1, wherein said continuous high modulus polypropylene yarns have been drawn to a ratio of 10 to 1.

29. The reinforced article of claim 28, wherein the drawn continuous high modulus polypropylene yarns have been heat set.

30. The reinforced article of claim 1, wherein said continuous high modulus polypropylene yarns have been drawn to a ratio of 18 to 1.

31. The reinforced article of claim 30, wherein the drawn continuous high modulus polypropylene yarns have been heat set.

32. The reinforced article of claim 1, wherein said continuous high modulus polypropylene yarns are adhesively bonded into a scrim.

33. The reinforced article of claim 1, wherein said continuous high modulus polypropylene yarns have been thermally bonded into a scrim.

34. The reinforced article of claim 1, wherein said continuous high modulus polypropylene yarns are weft inserted into a warp knit fabric.

* * * * *